US005979811A

United States Patent [19]

Bass et al.

[11] Patent Number: 5,979,811

[45] Date of Patent: Nov. 9, 1999

[54] CABLE PAYOUT TUBE

[75] Inventors: Benjamin Allen Bass; John Francis May, both of Omaha, Nebr.

[73] Assignee: Lucent Technologies Inc., Murray Hill, N.J.

[21] Appl. No.: 09/102,329

[22] Filed: Jun. 22, 1998

[51] Int. Cl.[6] ..... B65H 57/12; B65H 57/18; B65H 49/08

[52] U.S. Cl. ..... 242/157 R; 242/137.1; 242/163; 242/171; 242/125.2

[58] Field of Search ..... 242/588.3, 588.4, 242/588.6, 163, 171, 137.1, 157 R, 566, 593, 125.2, 580; 206/409

[56] References Cited

U.S. PATENT DOCUMENTS

| | | | |
|---|---|---|---|
| 1,063,646 | 6/1913 | Bournonville | 242/171 |
| 1,077,453 | 11/1913 | Case | 242/137.1 |
| 3,178,130 | 4/1965 | Taylor | 242/163 |
| 4,274,607 | 6/1981 | Priest | 242/157 R |
| 4,669,681 | 6/1987 | Hansen et al. | 242/137.1 |
| 5,064,136 | 11/1991 | Hunt | 242/157 R |
| 5,115,995 | 5/1992 | Hunt | 242/157 R |
| 5,152,476 | 10/1992 | Moser | 242/157 R |
| 5,368,245 | 11/1994 | Fore | 242/163 |
| 5,520,347 | 5/1996 | Bass et al. | 242/157 R |

*Primary Examiner*—John M. Jillions

[57] ABSTRACT

A cable payout tube having a large diameter cable entrance end and an even larger cable exit end, for accommodating stiff cable without kinking thereof. The interior of the tube has cable gripping chambers extending along at least a portion of the length thereof, the chambers being tapered to allow wedging of the end of a cable therein. A flange and locking tabs enable mounting the tube in an opening in a carton containing the cable.

12 Claims, 3 Drawing Sheets

CABLE PAYOUT TUBE

FIELD OF THE INVENTION

This invention relates to arrangements for dispensing wire, cable, and the like from the containers in which it is coiled, and, more particularly, to a payout tube disposed within the container and communicating through a wall thereof to the exterior, through which the wire, cable, or the like is passed.

BACKGROUND OF THE INVENTION

It is the current practice in packaging insulated communication wire to coil the wire in a figure 8 configuration of the coil which is used to reduce twisting of the wire as it is coiled, thereby reducing a tendency of the wire to kink as it is pulled from the carton, generally through an opening in a side wall thereof. The pulling process is facilitated by the installation of a payout tube which extends into the interior of the carton, and which is affixed to a wall thereof in a suitable manner so as to have a stub portion extending outside of the carton. In U.S. Pat. No. 5,152,476 of Moser, there is shown a preferred arrangement for affixing the tube to the wall of the carton having a modified bayonet lock type of action. Numerous prior art arrangements utilize this arrangement, or modifications thereof, for mounting the tube.

Most tubes in use today are in the form of hollow elongated cylinders with the ends thereof being radiused between the outer and inner walls to eliminate sharp corners over which the wire passes as it is pulled through the tube. Such radiused ends are shown in U.S. Pat. Nos. 5,064,136 and 5,115,995 of Hunt. In these arrangements, the entrance end surface substantially conforms to a hemi-toroidal surface having a faired joinder at its inner and outer margins with the inner and outer walls of the tube. Such a rounded surface imposes a lower limit on the bend radius of the wire being pulled through the tube, which however, does not prevent kinking of the wire or damage to its insulation when the wire is being pulled from layers immediately adjacent to the tube and lying between the end of the tube and the wall in which the tube is mounted. In that case, the wire undergoes a sharp reverse bend as it enters the tube, and the radiused end of the tube is insufficient to prevent kinking and possible damage.

The aforementioned Moser patent discloses an end cap for the entrance end of the payout tube which greatly increases the minimum possible radius of curvature of the wire, thereby materially reducing the tendency of the wire to kink even in the extreme reverse bend case discussed in the foregoing. The cap of the Moser patent has, at its entrance or back end an annular flange, the surface area of which conforms to approximately one cross-sectional quadrant of a toroidal surface having a radius of sufficient magnitude that when the wire is bent to pass over the surface in contact therewith, it will not kink. The toroidal surface of the cap is faired into a flat surface, the plane of which is substantially normal to the axis of the cap, and which borders the wire passage interior cylindrical wall surface of the cap. In use, the hollow cylindrical payout tube is mounted in the carton, and the cap is affixed to the entrance end, ie., the interior or rear end. The wire being payed out cannot be bent to a radius less than the radius of the flange, even for a complete reverse bend, except where the wire passes into the payout tube. At the region where the cap joins the payout tube, there remains a relative small radiused surface over which the wire passes, which allows the wire to be bent to a radius that is too small to prevent kinking, i.e., the radius is less than the critical radius $R_c$, below which kinking can occur.

Any cap arrangement for the payout tube gives rise to the additional problem of the introduction of a separate part, with the possibility of its being lost or mislaid. Also, the fabrication of such a separate part requires additional molds and fabrication steps, thereby increasing the cost of the payout tube assembly. Moser apparently recognizes the problem at least to some extent, by suggesting that the cap and the payout tube may be fused together to produce a single unitary structure, but apparently the two parts are intended to be fabricated separately and then joined, with a consequent two molding operations, hence, an increase in production costs.

In U.S. Pat. No. 5,520,347 of Bass et al. there is disclosed a one-piece payout tube which overcomes the aforementioned disadvantages of the Moser device as well as many other prior art devices. The Bass et al. (hereinafter "Bass") payout tube has a flange at the cable entrance end thereof which has a radiused surface, the radius being greater than the kinking radius $R_c$, and a central opening where the radiused surface fairs into the inner wall of the tube, with the inner wall being tangential to the radiused surface. The opposite or cable exit end of the tube has a mounting arrangement which is strengthened by suitable ribs and strength members, which are cast or formed integral with the remainder of the tube. The Bass patent is incorporated herein by reference.

There has been an increase in the use of cable having low smoke or flame resistant characteristics wherein, for the most part, the cable is jacketed with a low smoke material such as low smoke polyvinylchloride (PVC). Unfortunately, cables jacketed with such material display a greater tendency to kink than cables jacketed with other materials due to the additives in the PVC which reduce cable flexibility, with a consequent increased tendency to damage the insulation, and, in the extreme, possibly the wire itself. The aforementioned Bass arrangement does successfully minimize normally occurring kinking, but, especially where low smoke PVC is used as the insulating material, it is possible for some kinking to occur.

In use, a payout tube functions to guide cable out of the carton in, preferably, an unkinked condition, with a reasonable ease of payout. However, it is seldom the case that all of the cable contained in a carton is payed out at one time, i.e., in a single operation, and usually, after the desired length of cable has been pulled out, the cable is cut. When this occurs, the cable, which has been under tension, tends to spring back into the carton where it becomes inaccessible in the extreme case. Numerous arrangements have been used to prevent the cable from thus springing back, and for holding it fixed within the tube. One arrangement common in the prior art and shown in the Bass patent is a resilient diaphragm formed of wedge-shaped fingers adjacent the cable entrance end of the tube. The fingers are resilient enough to yield to the cable as it is pulled out under tension, but sufficiently stiff enough to resist the tendency for the cable to spring back after being cut, thereby holding the cable in place provided the spring back action is not too strong. U.S. Pat. No. 5,152,476 of Moser, U.S. Pat. No. 5,064,136 of Hunt and U.S. Pat. No. 4,274,607 of Priest all show such diaphragm arrangements. Provided cable tension is not excessive, such diaphragms perform adequately, but, as is the usual case, being integrally formed with the tube, they require complex mold designs which materially increase costs. An inherent disadvantage to such diaphragms is their tendency to prevent the cable that is being pulled out from untwisting. This can lead to a buildup of twist tension within the carton which, in turn, can lead to tangling or, worse, to knotting. Diaphragms also place a limit on the material from which the tube is made. For the diaphragms to work at all, they must be made of a resilient material such as polyethylene, and cannot function properly if made of a stiffer material such as a polycarbonate. Another arrangement in the prior art is an end cap which is designed to fit over the exit end of the tube, or a plug that fits into the exit end and which, in either case, pinches the cable against the tube to affix it in place. Such caps or plugs are easily misplaced or lost, and thus there is a built in unreliability in their use.

In virtually all of the payout arrangements of the prior art, difficulty in achieving smooth, regular payout is encountered at lower temperatures where the cable becomes stiff and difficult to handle. Inasmuch as payout at lower temperatures is common, an arrangement which provides smooth payout at low temperatures is highly desirable

SUMMARY OF THE INVENTION

The present invention is a payout tube for use with Reelex® and other types of boxed cables, usually wound in a figure 8 configuration, and is especially adapted to accommodate low smoke PVC jacketed cables at low ambient temperatures as well as at normal temperatures. The invention is based upon the discovery that a payout tube of large diameter, in the range of two to three times the interior diameter of prior art payout tubes, i.e., approximately two and one quarter to three inches, makes it possible to handle stiffer cables such as low smoke PVC jacketed cables over a wide range of temperatures, including temperatures as much as twenty to twenty-five degrees Fahrenheit (20°–25° F.) below normal temperatures, such as 0° F. for certain types of cables.

In greater detail, the payout tube is a tubular member having a cable entrance end and a cable exit end, being tapered from a first inner diameter in the range of two and one quarters to three inches (2¼"–3") at the cable entrance end to a second inner diameter of two and three-quarters to three and one half inches (2¾"–3½"), in other words, the inner diameter increases by approximately one-half an inch (½"). The inside edge of the tube at the cable entrance end is radiused and faired into the interior tube wall to facilitate passage of the cable into the tube and to prevent kinking.

On the interior wall of the tube are first and second substantially diametrically opposed longitudinally extending tapered hollow compartments which extend from the cable entrance end toward the cable exit end to within approximately one-half inch (½") thereof, being open toward the cable exit end. In use, after the desired length of cable has been payed out, it is cut and the end bent backward and inserted into the tapered compartment. The cable end is pushed into the tapered compartment until it becomes wedged therein and is thus prevented from springing back into the interior of the carton or box. Such an arrangement is especially effective with stiff cable which would otherwise resist the holding effects of the prior art diaphragm arrangements. The bent portion of the cable does not extend beyond the exit end of the tube whereas in most prior art arrangements, the end of the cable does. Thus the viable end of the cable is protected from damage. In addition, because the diameter of the payout tube is much greater than that of prior art tubes, the cable, during payout, does not generate as much tension, hence, there is less springback with which to contend.

The payout tube in its entirety is a single molded member and, in not having a diaphragm therein, does not require an intricate mold structure ordinarily necessary for inclusion of a diaphragm arrangement. Further, the tube may be made from almost any material that can be molded, whether a resilient plastic or a stiff plastic, for example.

The features and advantages of the present invention will be more readily apparent from the following detailed description, read in conjunction with the accompanying drawings.

DETAILED DESCRIPTION

Figure 1:
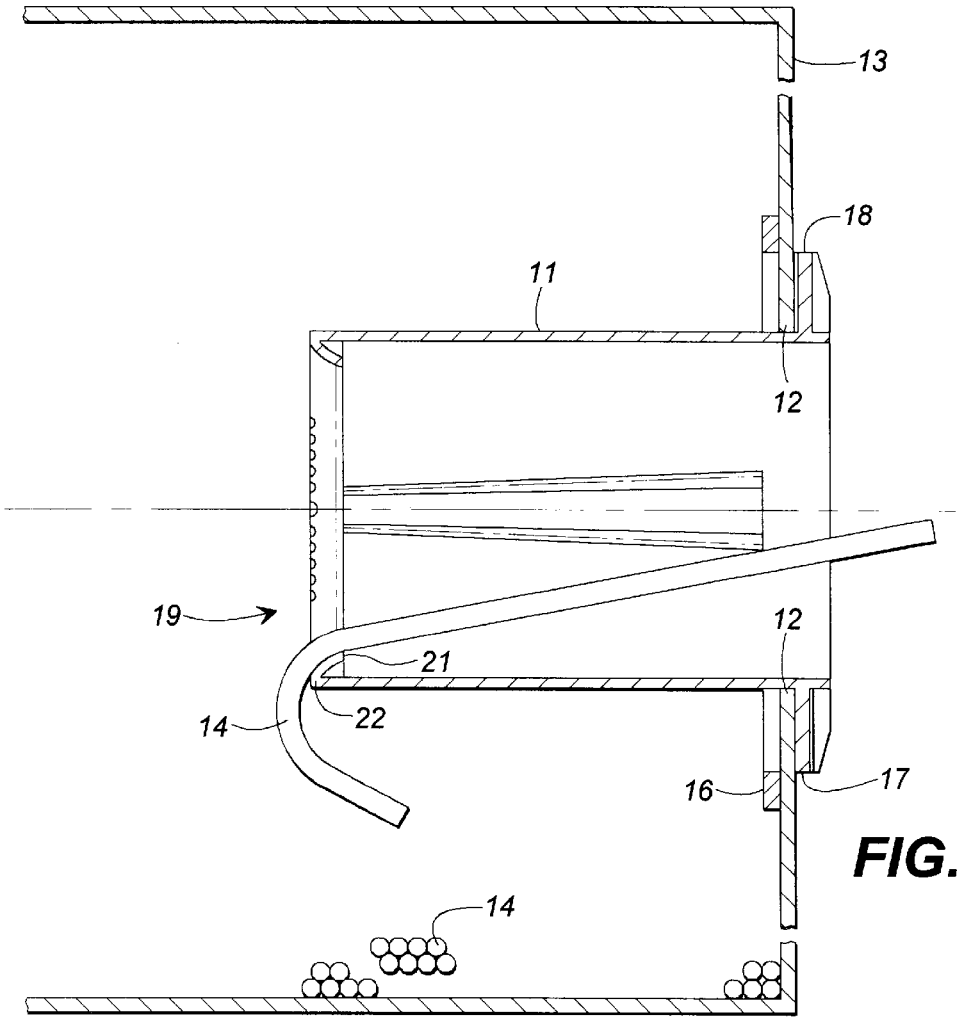
FIG. 1 is an elevation view of cross-section of the payout tube arrangement of the present invention.

In FIG. 1 there is shown, in cross section, the payout tube 11 of the invention as mounted in place in an opening 12 in one wall of a carton 13 of material such as corrugated cardboard. Within carton 13 there is wound, generally in a figure eight configuration, the cable 14, such as, for example, Reelex® jacketed with low smoke PVC. The payout tube 1 is mounted to the carton by means of a flange 16 and locking tabs 17 and 18 in the manner shown and described in the aforementioned Bass patent. It can be seen in FIG. 1 from the large ends that the cable 14 is relatively stiff and does not bear tightly against the lip of the cable entrance end 19 of tube 11, but will bear against the radiused inner edge 21, which, preferably, has a radius of approximately fourteen one-hundredths inches (0.14") and is faired into the inner wall of the tube. In this respect, the very stiffness of the cable prevents it from being damaged by the outer edge 22 of the cable entrance end 19.

Figure 2:
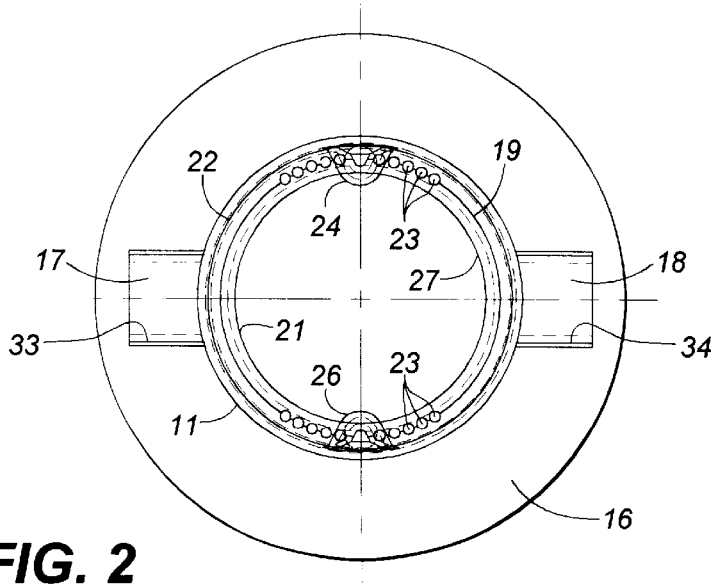
FIG. 2 is a top plan view of the payout tube of the invention.
Figure 3:
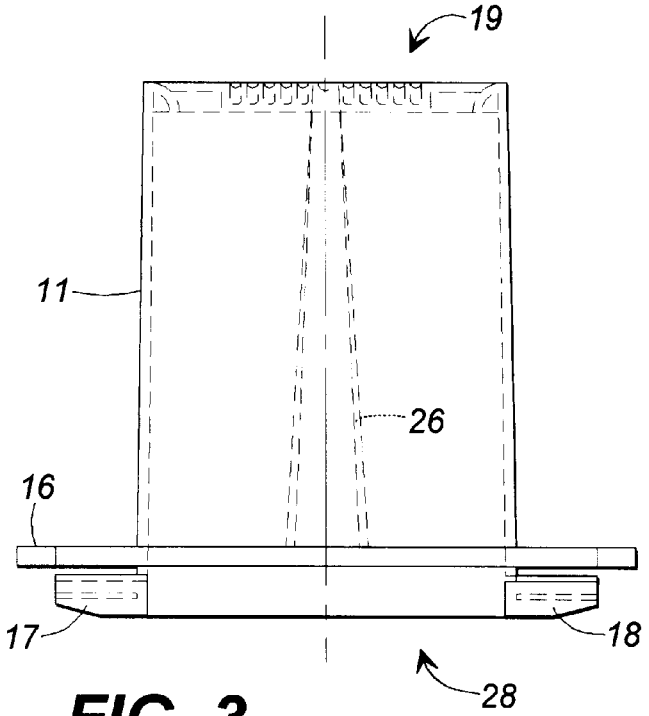
FIG. 3 is a side elevation view of the payout tube of the invention.
Figure 4:
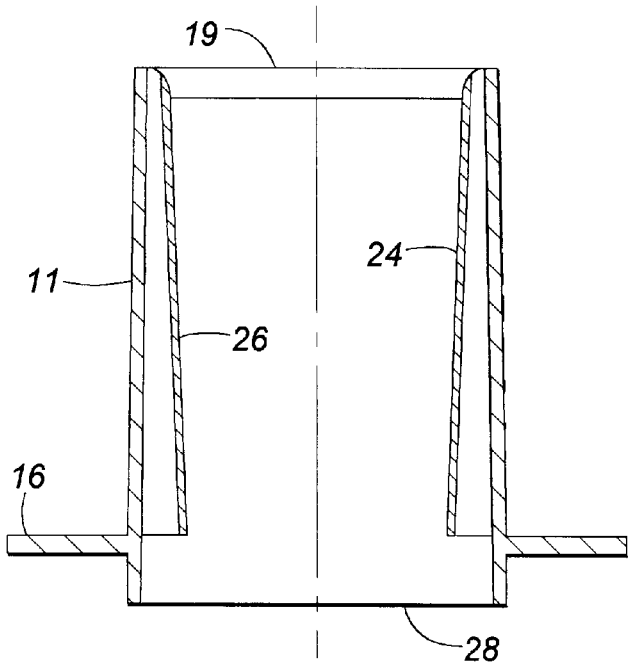
FIG. 4 is a cross-sectional elevation view of the tube of FIG. 3, rotated 90°.
Figure 5:
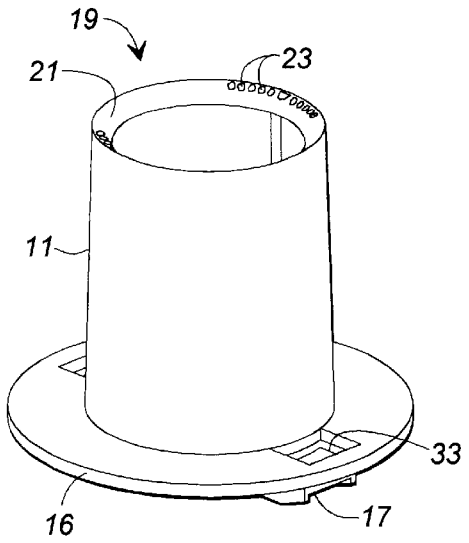
FIG. 5 is a perspective view of the payout tube of the invention.

FIG. 2 is a top plan view of the tube 11, considering, for purposes of explanation, the cable entrance end 19 as the top. The tube 11 is symmetrical about a central axis and the radiused inner edge 21 of the cable entrance end 19 has a plurality of holes 23 therein for purposes of lightening the tube 11 somewhat and for reducing the amount of material used in the molding process. Within the interior of tube 11 are first and second compartments 24 and 26 which, as best seen in FIGS. 3 and 4, extend longitudinally along the inner wall 27 of tube 11, and are integral therewith. The formation of the compartments occurs in the molding process, and requires a far less complicated mold than one for a tube having an interior diaphragm. As best seen in FIGS. 3, 4, and 5, adjacent the cable exit end 28 is a circular mounting flange 16, and spaced therefrom are mounting and locking tabs 17 and 18 which function in the same manner as the sloped mounting tabs shown in the Bass patent for bayonet locking the tube 11 to the wall of the carton 13. Flange 16 also has first and second openings 33 and 34 therein which overlie tabs 17 and 18 respectively, and which are formed during the molding process. As was discussed hereinbefore, the interior of tube 11 is tapered from a first, larger diameter at the cable exit end to a second, smaller diameter at the cable entrance end. As pointed out hereinbefore, these diameters are considerably greater than those of prior art devices as exemplified by the Bass patent. Thus, where the inside diameter of the Bass device at the cable entrance end is slightly more than six-tenths of an inch (0.6"), the corresponding diameter of the tube 11 is two and one-quarter to three inches (2.25"–3.0"). Such a large diameter difference results in the capability, on the part of the present invention, to accommodate without kinking much stiffer cables than can readily be done by the prior art devices. Furthermore, as will be discussed more fully hereinafter, the large interior diameter makes possible the unique arrangement for holding the cable against springback as opposed to a resilient diaphragm. The interior diameter of the tube 11 at the exit end is in the range of two and three-quarters to three and one-half inches (2.75"–3.5"), the net change in diameter preferably being approximately one-half inch (0.5"). Thus, for a diameter at the cable entrance end 19 of, for example, two and one-half inches (2.5"), the diameter at the exit end 28 is three inches (3.0"). FIG. 5 is a perspective view of the payout tube 11 of the present invention, which is approximately four inches (4.0") long and the flange 16 of which is approximately four and six-tenths inches (4.6") in diameter.

The results that have been attained with the tube of the present invention are startling. In addition to the superior low temperature performance, the even more unexpected is the reduction in pull-out tension. The average tension to pull twenty inches of cable from standard prior art cartons and payout tubes is 3.152 pounds. For the payout tube of the invention, the average tension required is 0.723 pounds. Reduced tension means less kinking, less damage to the cable, and much less effort on the part of the user.

Figure 6:
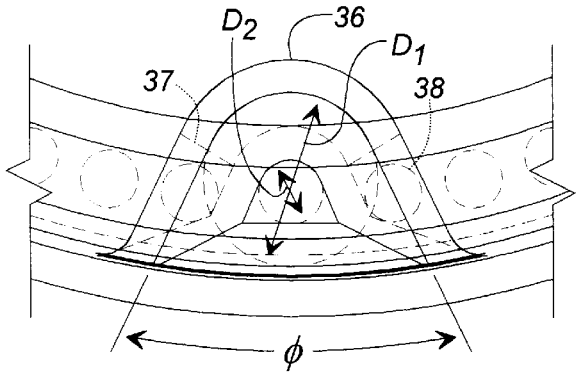
FIG. 6 is a detail view of an element of the payout tube of the invention.
Figure 7:
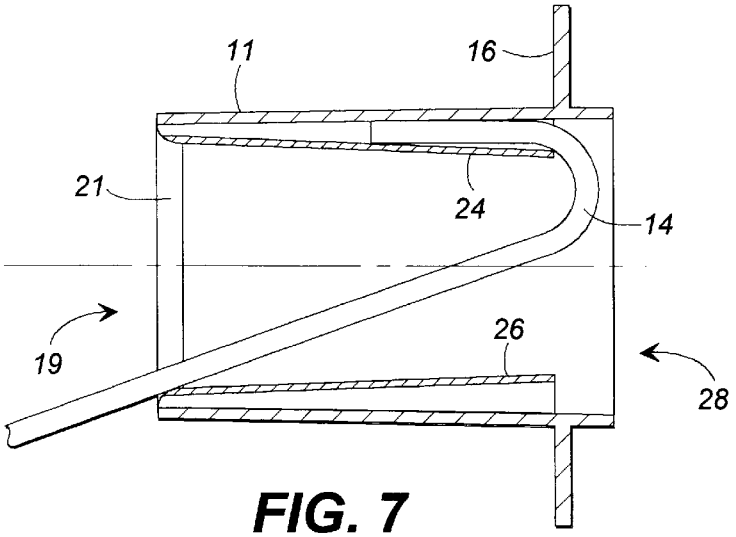
FIG. 7 is a cross-sectional view illustrating the operative function of the element of FIG. 6.

As best seen in FIGS. 4 and 6, elongated chambers 24 and 26 are open at the cable exit end 28, having a curved wall 36 of an inner diameter $D_1$ of approximately twenty-eight one-hundredths of an inch (0.28") which has side walls 37 and 38 which are faired into the wall of tube 11 as shown. The included angle Ø of the side walls 37 and 38 is approximately fifty degrees (50°). Each chamber has an approximate five degree (5°) taper along its length and the interior wall diminishes to approximately a diameter $D_2$ of one-tenth inch (0.1") adjacent the cable entrance end 19, where it fairs into radiused lip or edge 21. In FIG. 7 is shown the manner in which compartments 24 and 26 are used to hold the end of the cable against the springback force. After the desired length of cable has been payed out, the cable 14 is bent and the end is inserted into one of the chambers 24 or 26, and pushed in until it becomes wedged in the tapered chamber. As can be seen, if the end of chamber 24, for example, is sufficiently spaced from the cable exit end (approximately 0.5"), the cable will not protrude out of the tube, hence, it remains protected thereby. The very stiffness of the cable contributes to the holding action, since its normal tendency is to straighten out, which causes it to press against the wall of the chamber.

From the foregoing, it can readily be appreciated that the payout tube of the invention achieves the desired ends of reducing kinking in stiff cables and holding the cable end against springback in a unitary, relatively easily moldable configuration.

In concluding the detailed description, it should be noted that it will be obvious to those skilled in the art that many variations and modifications may be made to the preferred embodiment without substantial departure from the principles of the present invention. All such variations and modifications are intended to be included herein as within the scope of the present invention as set forth in the claims. Further, in the claims hereafter, the corresponding structures, materials, acts, and equivalents of all means or step plus function elements are intended to include any structure, material, or acts for performing the functions with other claimed elements as specifically claimed.

We claim:

1. A payout tube for use with a container having wire or cable therein for guiding the wire or cable from the interior of the container to the exterior thereof, said payout tube comprising:

a tubular body comprising a moldable material having an exterior wall and an interior wall defining a passage for the wire or cable, said tubular body having a central axis and a cable entrance end and a cable exit end;

at least one elongated chamber member on said inner wall and extending from said cable entrance end toward said cable exit end, said chamber having an opening in one end facing said cable exit end and defining an interior passage in said chamber; and means on said exterior wall for mounting said tubular body to the container.

2. A payout tube as claimed in claim 1 and further including a second elongated chamber member on said inner wall substantially diametrically opposite said one chamber member.

3. A payout tube as claimed in claim 1 where said interior passage is tapered.

4. A payout tube as claimed in claim 3 wherein said interior passage is largest at the said one end and becomes progressively smaller toward said cable entrance end.

5. A payout tube as claimed in claim 1 wherein said one end is spaced from said cable exit end.

6. A payout tube as claimed in claim 5 wherein the distance said one end is spaced from said cable exit end is approximately one-half of one inch.

7. A payout tube for use with a container having wire or cable therein for guiding the wire or cable from the interior of the container to the exterior thereof, the container having an aperture therein for receiving the payout tube, said payout tube comprising:

a tubular body comprising a moldable material having an exterior wall and an interior wall defining a passage for the wire or cable, said tubular body having a central axis and a cable entrance end and a cable exit end;

said interior wall having a first diameter at said cable entrance end that is less than a second interior diameter at said cable exit end, said first interior diameter being in the range of two and one-quarter inches of three inches for accommodating stiff cables without kinking thereof;

mounting means on said tubular body adjacent said cable exit end; and cable gripping means on said interior wall and extending along at least a portion of the length thereof, said cable gripping means comprising a first longitudinally extending chamber having an interior passage extending along at least a portion of the length of said chamber.

8. A payout tube as claimed in claim 7 wherein said interior passage has an open end facing said cable exit end.

9. A payout tube as claimed in claim 8 wherein said interior passage is tapered from a maximum at said open end to a minimum toward said cable entrance end.

10. A payout tube as claimed in claim 7, and further including a second longitudinally extending chamber on said interior wall substantially diametrically opposite said first chamber.

11. A payout tube for use with a container having wire or cable therein for guiding the wire or cable from the interior of the container to the exterior thereof, said payout tube comprising:

a tubular body having an exterior wall and an interior wall defining a passage for the wire or cable, said tubular body having a central axis and a cable entrance end and a cable exit end;

at least one elongated cable gripping member on said interior wall and extending along at least a portion of the length of said interior wall;

said cable gripping member being spaced from the central axis of said tubular body and extending from a point adjacent said cable exit end and spaced therefrom toward said cable entrance end.

12. A payout tube as claimed in claim 11 wherein the spacing between said cable gripping means and said cable exit end is sufficient to prevent the cable, when gripped by said gripping means, from extending from within said tube beyond said exit end.

* * * * *